US012185751B2

(12) United States Patent
Kim et al.

(10) Patent No.: US 12,185,751 B2
(45) Date of Patent: Jan. 7, 2025

(54) SMOKE COMPONENT-REDUCING CIGARETTE FILTER, CIGARETTE, AND MANUFACTURING METHOD THEREFOR

(71) Applicant: KT&G CORPORATION, Daejeon (KR)

(72) Inventors: Soo Ho Kim, Daejeon (KR); Jin Chul Yang, Daejeon (KR); Man Seok Seo, Daejeon (KR); Jong Yeol Kim, Daejeon (KR); Youn Keun Oh, Sejong (KR); Tae Hoon Kim, Seoul (KR); Moon Soo Yoon, Seoul (KR)

(73) Assignee: KT&G CORPORATION, Daejeon (KR)

( * ) Notice: Subject to any disclaimer, the term of this patent is extended or adjusted under 35 U.S.C. 154(b) by 832 days.

(21) Appl. No.: 17/251,526

(22) PCT Filed: Jul. 3, 2019

(86) PCT No.: PCT/KR2019/008160
§ 371 (c)(1),
(2) Date: Dec. 11, 2020

(87) PCT Pub. No.: WO2020/009479
PCT Pub. Date: Jan. 9, 2020

(65) Prior Publication Data

US 2021/0244086 A1 Aug. 12, 2021

(30) Foreign Application Priority Data

Jul. 6, 2018 (KR) ..... 10-2018-0079037

(51) Int. Cl.
*A24D 3/02* (2006.01)
*A24D 3/04* (2006.01)

(52) U.S. Cl.
CPC ..... *A24D 3/0287* (2013.01); *A24D 3/04* (2013.01)

(58) Field of Classification Search
CPC ..... A24D 3/02; A24D 3/0229; A24D 3/0287; A24D 3/04; A24D 3/06; A24D 3/062; A24D 3/065
(Continued)

(56) References Cited

U.S. PATENT DOCUMENTS 2,039,298 A * 5/1936 Davidson ..... A24D 3/0204 493/45
2,164,702 A * 7/1939 Davidson ..... A24D 3/0245 156/203
(Continued)

FOREIGN PATENT DOCUMENTS

CN 1057574 A 1/1992
CN 1688376 A 10/2005
(Continued)

OTHER PUBLICATIONS

International Search Report of PCT/KR2019/008160 dated Oct. 1, 2019 [PCT/ISA/210].
(Continued)

*Primary Examiner* — Gloria R Weeks
(74) *Attorney, Agent, or Firm* — Sughrue Mion, PLLC

(57) ABSTRACT

A cigarette filter comprises a first filter portion comprising an irregularly folded and packed polymer sheet, and a first cigarette filter wrapping paper surrounding the polymer sheet, wherein the polymer sheet comprises a first polymer layer containing polyolefin or polyester and a second polymer layer positioned on the first polymer layer and containing polyolefin.

20 Claims, 3 Drawing Sheets

(58) Field of Classification Search
USPC ..... 493/39, 50
See application file for complete search history.

(56) References Cited

U.S. PATENT DOCUMENTS 3,356,094 A * 12/1967 Drummond ..... A24D 1/002 131/273
3,648,712 A * 3/1972 Patterson ..... A24D 3/045 131/339
3,882,877 A * 5/1975 Brackmann ..... A24D 3/08 131/332
RE28,487 E * 7/1975 Muller ..... A24D 1/04 131/261
4,034,765 A * 7/1977 Hall ..... A24D 3/02 131/344
4,059,121 A * 11/1977 Brackmann ..... A24D 3/04 131/332
4,219,031 A * 8/1980 Rainer ..... A24B 15/165 131/340
4,267,002 A * 5/1981 Sloan ..... D04H 1/5412 264/DIG. 75
4,481,958 A * 11/1984 Rainer ..... A24D 3/10 131/369
4,492,240 A * 1/1985 Hayes ..... A24D 3/043 131/338
4,516,589 A * 5/1985 Rainer ..... A24D 3/16 131/342
4,807,809 A * 2/1989 Pryor ..... A24C 5/18 493/42
4,869,275 A * 9/1989 Berger ..... A24D 3/08 131/332
4,880,448 A * 11/1989 Scherrer ..... B03C 3/28 96/414
4,903,714 A * 2/1990 Barnes ..... A24D 3/0233 131/194
4,967,774 A * 11/1990 White ..... A24F 42/60 131/194
5,053,066 A * 10/1991 Hassenboehler .. B01D 39/1623 55/528
5,069,231 A * 12/1991 Rutherford ..... A01K 55/00 131/273
5,105,834 A * 4/1992 Saintsing ..... A24B 15/24 131/342
5,246,017 A * 9/1993 Saintsing ..... A24D 3/14 131/342
5,275,859 A * 1/1994 Phillips ..... A24D 3/08 428/116
5,396,909 A * 3/1995 Gentry ..... A24D 3/14 131/332
5,404,890 A * 4/1995 Gentry ..... A24D 3/163 131/365
5,435,326 A * 7/1995 Gentry ..... A24D 1/00 131/338
5,465,739 A * 11/1995 Perfetti ..... A24D 3/08 131/335
5,568,819 A * 10/1996 Gentry ..... A24D 3/04 131/365
5,620,641 A * 4/1997 Berger ..... D04H 3/07 264/DIG. 48
5,622,190 A * 4/1997 Arterbery ..... A24D 3/06 131/345
5,874,373 A * 2/1999 Pryne ..... B32B 5/10 428/218
6,827,087 B2 * 12/2004 Wanna ..... A24D 1/025 131/365
8,201,564 B2 * 6/2012 McHugh ..... A24D 3/0212 493/44
8,439,046 B2 * 5/2013 Peters ..... A24D 3/16 131/331
8,940,073 B2 1/2015 Schmidt
8,950,407 B2 * 2/2015 Sebastian ..... A24D 3/06 428/297.4
9,687,024 B2 * 6/2017 Kaljura ..... A24D 3/025
2003/0203696 A1 10/2003 Healey
2004/0094172 A1 * 5/2004 Wanna ..... A24D 1/025 131/365
2008/0295853 A1 * 12/2008 Jones ..... A24D 3/163 131/343
2009/0020132 A1 * 1/2009 Peters ..... A24D 3/16 131/334
2011/0023900 A1 * 2/2011 Clarke ..... A24D 3/0208 131/345
2012/0067270 A1 3/2012 Huynh
2012/0167771 A1 7/2012 Schmidt
2013/0074853 A1 * 3/2013 Sebastian ..... B29C 55/30 131/334
2013/0112214 A1 * 5/2013 Bundren ..... D02G 1/00 977/734
2014/0026908 A1 1/2014 Motodamari et al.
2014/0070465 A1 * 3/2014 Kizer ..... B29C 48/78 264/474
2015/0001148 A1 * 1/2015 Pan ..... A24D 3/08 426/77
2017/0360087 A1 12/2017 Papakyrillou
2018/0177225 A1 6/2018 Jaramillo et al.
2021/0045436 A1 2/2021 Mucalo et al.
2021/0244086 A1 * 8/2021 Kim ..... A24D 3/0287
2021/0321667 A1 * 10/2021 Kubota ..... A24D 3/10

FOREIGN PATENT DOCUMENTS

CN 101150964 A 3/2008
CN 102421502 A 4/2012
CN 103732090 A 4/2014
CN 104382232 A 3/2015
CN 105167182 A 12/2015
CN 205947106 U 2/2017
JP 1-243979 A 9/1989
JP 7-67613 A 3/1995
JP 09-103280 A 4/1997
JP 2001-523478 A 11/2001
JP 2008-528011 A 7/2008
JP 2012-522628 A 9/2012
JP 2014-090720 A 5/2014
JP 2018-500030 A 1/2018
KR 10-2007-0096027 A 10/2007
KR 10-2010-0107505 A 10/2010
KR 10-1573986 B1 12/2015
KR 10-1594195 B1 2/2016
KR 10-2016-0048061 A 5/2016
KR 10-2018-0055551 A 5/2018
WO 99/26496 A2 6/1999
WO 2012/132009 A1 10/2012
WO 2014/207704 A2 12/2014
WO 2017/036909 A1 3/2017

OTHER PUBLICATIONS

Extended European Search Report dated Mar. 1, 2022, issued in European Application No. 19830142.6.
Office Action dated Dec. 13, 2022 from the Japan Patent Office in Application No. 2020-556302.
Office Action dated Apr. 29, 2022 issued by the Chinese Patent Office in Chinese Application No. 201980043408.8.

* cited by examiner

【Figure 1】
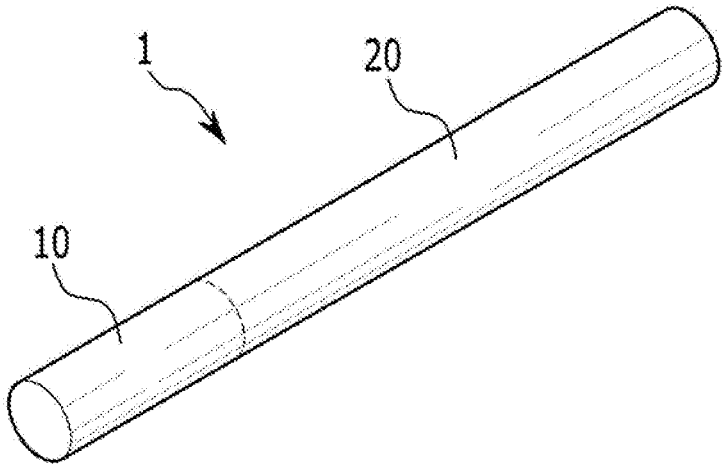
【Figure 2】
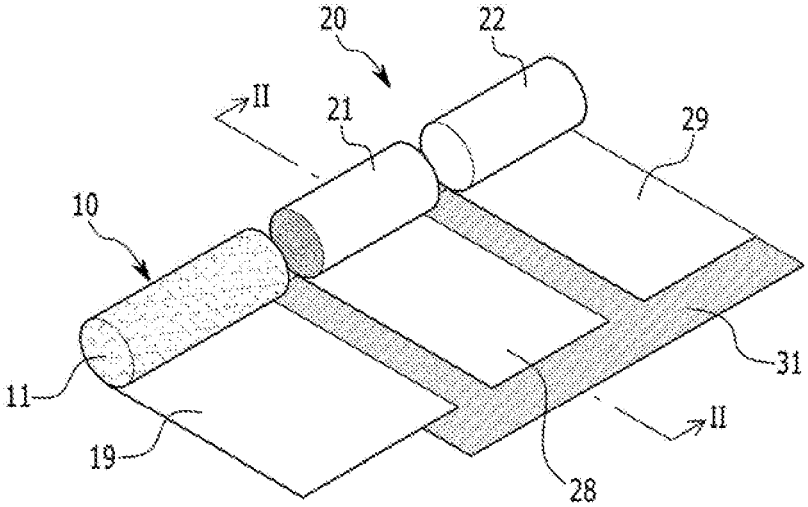

【Figure 3】
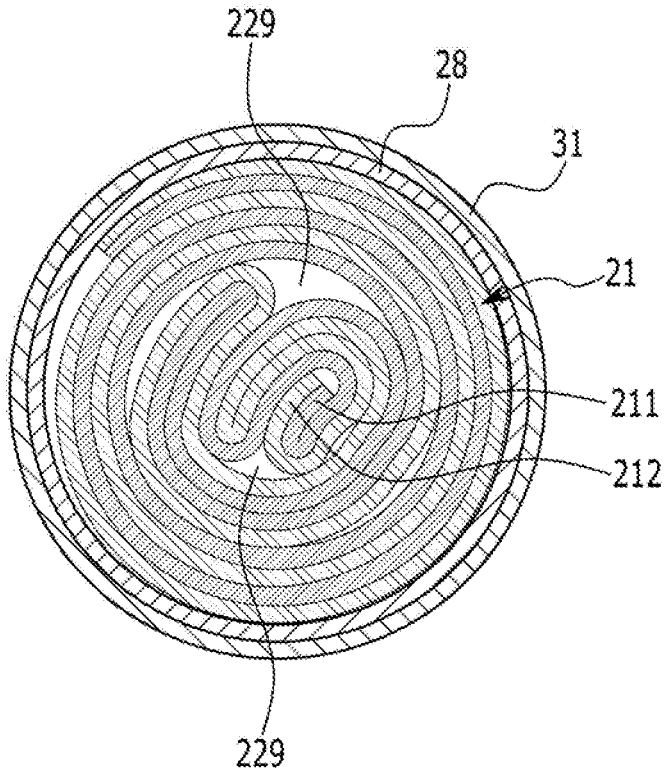
【Figure 4】
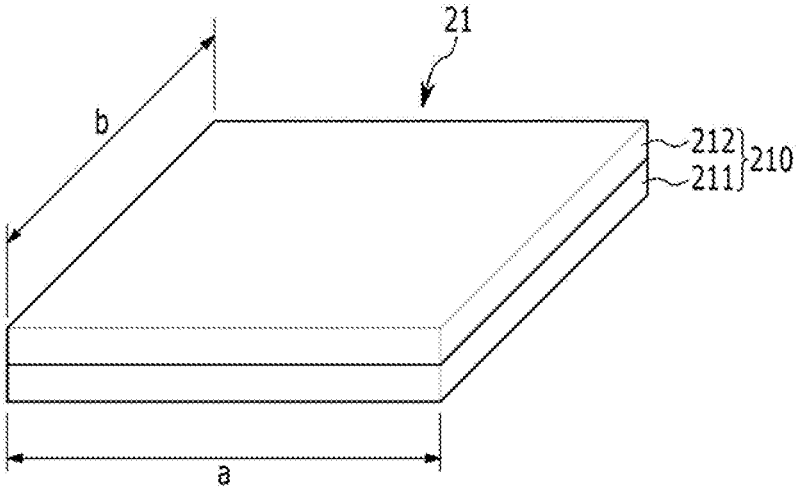

【Figure 5】
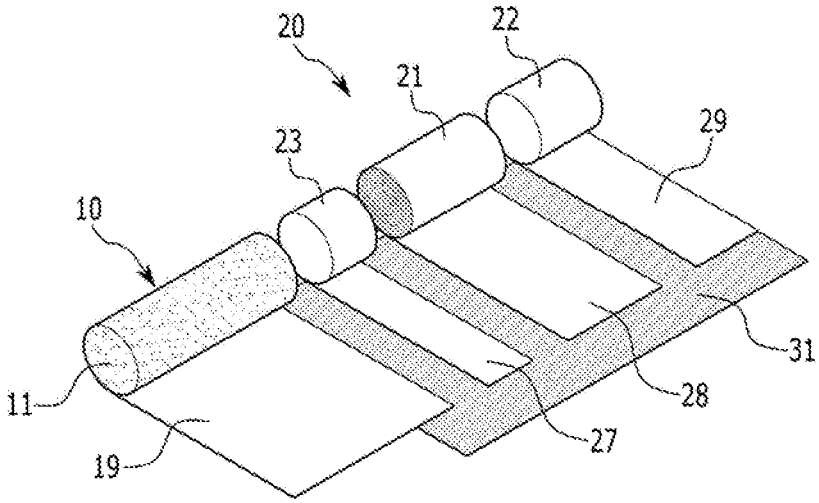

SMOKE COMPONENT-REDUCING CIGARETTE FILTER, CIGARETTE, AND MANUFACTURING METHOD THEREFOR

TECHNICAL FIELD

Provided are a smoke-component reducing cigarette filter, a cigarette, and a manufacturing method thereof.

BACKGROUND ART

In general, in order to manufacture a cigarette, first, various types of leaf tobaccos are mixed and processed to have a desired aroma and taste. Next, cut tobacco leaves are prepared by cutting the processed leaf tobacco, and the cut tobacco leaves are rolled with a cigarette paper to manufacture a cigarette without a filter. Next, a filter is attached to the cigarette without the filter as needed.

The cigarette paper may be made of flax, wood pulp, etc., and when burned, it is required to maintain the flammability and taste of the cigarette. The cigarette filter may include activated carbon, flavoring materials, etc., and may consist of a mono filter or multiple filters, and the cigarette filter is surrounded by a cigarette filter wrapping paper. The cut tobacco leaf portion and the cigarette filter are connected to each other by a tipping paper, and the tipping paper may include minute holes.

In general, a cigarette filter uses cellulose acetate tow that is acetylated by extracting cellulose from wood pulp. When the cigarette filter is manufactured with acetate tow, a plasticizer or a hardener is used to improve the hardness of the cigarette filter. This is because a cigarette filter and cigarette can be smoothly manufactured only when the hardness of the cigarette filter is improved. When the hardness of the cigarette filter is low, the cigarette filter is not hard, so that the cigarette filter may be caught in a drum in the manufacturing process of the cigarette filter or the cigarette. In addition, the cigarette filter should have suitable suction resistance for smoking while filtering tar, nicotine, VOC, etc. contained in the cigarette smoke. Accordingly, studies on a cigarette filter having an excellent filtering function and appropriate suction resistance while having excellent hardness and workability have been conducted with respect to various materials.

U.S. Pat. No. 4,869,275 relates to "Ultra-high filtration", and discloses a cigarette filter formed in a bulky tow shape in which polymer fiber webs such as polypropylene and polyethylene terephthalate are entangled with each other by a melt-blown method. However, the bulky tow type cigarette filter using the polymer fiber webs has a high TPM filtering function of 70% or more, but is weak in a tar and nicotine filtering function, has no proper suction resistance, and is low in hardness and workability, and thus, the bulky tow type cigarette filter is not easy to be used for manufacturing the cigarette.

PRIOR ARTS

Patent Document (Patent Document 1) U.S. Pat. No. 4,869,275

DISCLOSURE

Technical Problem

An embodiment of the present invention is to have a high tar and nicotine filtering function in addition to a high TPM filtering function.

An embodiment of the present invention is to have hardness and workability easy for manufacturing a cigarette while having proper suction resistance.

Embodiments according to the present invention can be used to achieve other objects not specifically mentioned other than the objects.

Technical Solution

According to an embodiment of the present invention, a cigarette filter comprises a first filter portion comprising an irregularly folded and packed polymer sheet, and a first cigarette filter wrapping paper surrounding the polymer sheet, wherein the polymer sheet comprises a first polymer layer containing polyolefin or polyester and a second polymer layer positioned on the first polymer layer and containing polyolefin.

The first polymer layer may be folded to contact each other, and the second polymer layer may be folded to contact each other.

The cigarette filter may further comprise a second filter portion, wherein the second filter portion may be connected to the first filter portion and positioned at an oral region of the cigarette.

The second filter portion may include acetate tow, and may be surrounded by a second cigarette filter wrapping paper.

The polymer sheet may have a horizontal length (a) and a vertical length (b), and may be folded irregularly in a direction of the horizontal length (a).

According to an embodiment of the present invention, a cigarette comprises a cigarette filler portion; a cigarette paper surrounding the cigarette filler portion; a cigarette filter portion connected to the cigarette filler portion; and a tipping paper connecting the cigarette filler portion and the cigarette filter portion, wherein the cigarette filter portion comprises a first filter portion including an irregularly folded and packed polymer sheet, and a first cigarette filter wrapping paper surrounding the polymer sheet, wherein the polymer sheet comprises a first polymer layer containing polyolefin or polyester, and a second polymer layer positioned on the first polymer layer and containing polyolefin.

According to an embodiment of the present invention, a manufacturing method of a cigarette filter comprises the steps of preparing a first polymer layer using polyolefin or polyester; preparing a polymer sheet by forming a second polymer layer on the first polymer layer using polyolefin; preparing a first filter portion by irregularly folding the polymer sheet; and surrounding the first filter portion with a first cigarette filter wrapping paper.

The second polymer layer may be laminated on the first polymer layer by a melt-blown process.

The polymer sheet may be folded irregularly by a crimping process.

Advantageous Effects

According to an embodiment of the present invention, it is possible to have a high tar and nicotine filtering function in addition to a high TPM filtering function and have hardness and workability easy for manufacturing a cigarette while having proper suction resistance.

DESCRIPTION OF DRAWINGS

FIG. 1 is a perspective view schematically illustrating a cigarette according to an embodiment of the present invention.

FIG. 2 is a perspective view schematically illustrating a cigarette according to an embodiment of the present invention.

FIG. 3 is a cross-sectional view taken along the line II-II of a cigarette of FIG. 2.

FIG. 4 is a perspective view illustrating a sheet constituting a cigarette filter according to an embodiment of the present invention.

FIG. 5 is a perspective view schematically illustrating a cigarette according to an embodiment of the present invention.

BEST MODE

Hereinafter, embodiments of the present invention will be described in detail with reference to the accompanying drawings so as to be easily implemented by those with ordinary skill in the art to which the present invention pertains. The present invention may be implemented in various different forms and is not limited to embodiments described herein. Parts not associated with description are omitted for clearly describing the present invention and like reference numerals designate like or similar components throughout the specification. In the case of well-known technology, detailed description thereof will be omitted.

In the drawings, the thicknesses of various layers and regions are exaggerated for clarity. When a part such as a layer, a film, a region, a substrate, etc., is located "on" the other part, there are cases where the part may be located "directly on" the other part and another part may be interposed therebetween. In contrast, when a certain part is located "directly on" the other part, there are no intervening parts present. On the contrary, when a part such as a layer, a film, a region, a substrate, etc., is located "below" the other part, there are cases where the part may be located "directly below" the other part and another part may be interposed therebetween. In contrast, when a certain part is located "directly below" the other part, there are no intervening parts present.

Throughout the specification, when a certain part "comprises" a certain component, unless otherwise described to the contrary, it is meant that another component may be further included without excluding another component.

Then, a smoke-component reducing cigarette filter and a cigarette according to an embodiment of the present invention will be described.

FIG. 1 is a perspective view schematically illustrating a cigarette according to an embodiment of the present invention, FIG. 2 is a perspective view schematically illustrating a cigarette according to an embodiment of the present invention, FIG. 3 is a cross-sectional view taken along the line II-II of a cigarette of FIG. 2, FIG. 4 is a perspective view illustrating a sheet constituting a cigarette filter according to an embodiment of the present invention, and FIG. 5 is a perspective view illustrating a sheet constituting a cigarette filter according to an embodiment of the present invention.

Referring to FIGS. 1 to 5, a cigarette 1 includes a cigarette filler portion 10 burned by fire and a cigarette filter portion 20 filtering the cigarette smoke. The cigarette filler portion 10 may be surrounded by a cigarette paper 19, and the cigarette filter portion 20 may be surrounded by cigarette filter wrapping papers 27, 28, and 29. The cigarette filler portion 10 and the cigarette filter portion 20 may be connected to each other by a tipping paper 31. A circumference of the cigarette may be about 10 mm to about 30 mm.

The cigarette paper 19 may include a filler, thereby increasing the opacity of the cigarette paper, imparting the porosity to the cigarette paper, improving the smoothness and ash integrity of the cigarette paper, and increasing the whiteness of the cigarette paper. For example, the filler includes materials such as calcium carbonate, titanium dioxide, and magnesium oxide.

The cigarette filter portion 20 may be a multiple filter including two or more filter members. For example, referring to FIG. 2, the cigarette filter portion 20 may include a first filter portion 21 and a second filter portion 22. Referring to FIG. 5, the cigarette filter portion may include a first filter portion 21, a second filter portion 22, and a third filter portion 23.

In addition, the cigarette filter portion 20 may include an adsorbent, a flavoring agent, and the like. For example, the adsorbent may be activated carbon or the like, and the flavoring agent may be a herbal flavoring material or the like. In the multiple filter, one or more filter members may include at least one of an adsorbent and a flavoring agent.

Referring to FIGS. 3 and 4, the first filter portion 21 is surrounded by a first cigarette filter wrapping paper 28 and may include an adsorbent, a flavoring agent, and the like. A polymer sheet 210 is irregularly folded in the first filter portion 21. The polymer sheet 210 includes a first polymer layer 211 and a second polymer layer 212 positioned on the first polymer layer 211.

The first polymer layer 211 may include one or more polyolefins such as polypropylene, polyesters such as polyethylene terephthalate, and the like. For example, a basis weight of the first polymer layer 211 may be about 5 GSM to about 20 GSM, and in this range, the adhesion between the second polymer layer 212 and the first polymer layer 211 may be improved.

The second polymer layer 212 may include polyolefin such as polypropylene. The second polymer layer 212 may be formed on the first polymer layer 211. For example, the second polymer layer 212 may be formed by a melt-blown method. The second polymer layer 212 may be sprayed toward the first polymer layer 211 by a spinning nozzle in a molten state, and may be laminated on the first polymer layer 211. A basis weight of the second polymer layer 212 may be about 10 GSM to about 30 GSM, and in this range, the adhesion between the second polymer layer 212 and the first polymer layer 211 may be improved. The basis weight of the second polymer layer 212 may be larger than the basis weight of the first polymer layer 211.

The polymer sheet 210 is irregularly folded without a plasticizer. For example, as illustrated in FIG. 3, the first polymer layer 211 may be folded to contact each other, and the second polymer layer 212 may be folded to contact each other. Since the plasticizer is not included, the thermal stability of the cigarette filter may be increased, the process may be simplified, and the cost may be reduced. The size of the polymer sheet 210 may have a horizontal length a of about 150 to 300 mm and a vertical length b of about 5 to 30 mm. The polymer sheet 210 may be irregularly folded in a direction of the horizontal length a.

In the polymer sheet 210, a ratio of the horizontal length a to a diameter of the first filter portion 21 may be about 20 to about 45. When the ratio of the horizontal length a to the diameter of the first filter portion 21 is about 20 or more, the workability for manufacturing the cigarette may be easy, and a function of filtering TPM, tar, nicotine, etc. of the first filter portion 21 may be maintained. When the ratio of the horizontal length a to the diameter of the first filter portion 21 is about 45 or less, the polymer sheet 210 may be folded smoothly in a crimping process, and the first filter portion 21 may have proper suction resistance. For example, when the diameter of the first filter portion 21 is about 8 mm, the horizontal length a of the polymer sheet 210 may be about 160 mm to 360 mm. The horizontal length a may be preset according to the diameter of the first filter portion 21.

The vertical length b of the polymer sheet 210 may be an integer multiple of the length of the first filter portion 21. After the polymer sheet 210 is folded, the polymer sheet 210 may be cut by the length of the first filter portion 21.

Referring to FIG. 3, the first filter portion 21 includes a plurality of pores 229. The pore 229 is a space in which the polymer sheet 21 is not folded in the first filter portion 21. Through the pores 229 and the pores of the polymer sheet 210, a user may inhale cigarette smoke.

For example, the first filter portion 21 may be densely packed with the polymer sheet 210 folded irregularly by a crimping method.

Depending on the packed degree of the polymer sheet 210, the horizontal length a may be preset, and an area of the plurality of pores 229 may be changed.

Since the polymer sheet 210 including the first polymer layer 211 and the second polymer layer 212 is irregularly folded and packed, the cigarette filter portion 20 including the first filter portion 21 may have a high tar and nicotine filtering function in addition to a high TPM filtering function. In addition, due to the dense packing and pores of the polymer sheet 210, and the pores 229 of the first filter portion 21, the cigarette filter portion 20 may have the hardness and workability easy to manufacture the cigarette while having appropriate suction resistance.

The second filter portion 22 is surrounded by the second cigarette filter wrapping paper 29 and may include an adsorbent, a flavoring agent, and the like. The second filter portion 22 may include acetate tow. Referring to FIGS. 2 and 5, the second filter portion 22 is positioned at an oral region of the cigarette.

The third filter portion 23 is surrounded by the third cigarette filter wrapping paper 27 and may include an adsorbent, a flavoring agent, and the like. The third filter portion 23 may include acetate tow. Referring to FIG. 5, the third filter portion 23 is positioned between the cigarette filler portion 10 and the first filter portion 21.

Then, a manufacturing method of a cigarette filter will be described in detail.

The manufacturing method of the cigarette filter comprises the steps of preparing a first polymer layer using at least one of polyolefin, polyester, etc., preparing a polymer sheet by forming a second polymer layer on the first polymer layer using polyolefin, preparing a first filter portion by irregularly folding the polymer sheet, and surrounding the first filter portion with a first cigarette filter wrapping paper.

The second polymer layer may be laminated on the polymer layer by a melt-blown process.

The polymer sheet may be folded irregularly by a crimping process.

Modes of the Invention

Hereinafter, the present invention will be described in more detail with reference to Examples, but the following Examples are only examples of the present invention and the present invention is not limited to the following Examples.

Preparation of Polymer Sheet

Example 1

A first polymer layer having a basis weight of about 14 GSM was prepared using polypropylene. A polymer sheet was prepared by laminating a second polymer layer having a basis weight of about 18 GSM on the first polymer layer using polypropylene by a melt-blown process. The thickness of the prepared polymer sheet was about 127 micrometers.

Preparation of Cigarette Filter Portion

Example 2

The polymer sheet prepared in Example 1 was irregularly folded by a crimping process to prepare a cylindrical first filter portion without using a plasticizer. The prepared first filter portion was about 12 mm in the length, about 57 $mmH_2O$ in the suction resistance, and about 88% in the hardness. The workability of preparing the first filter portion was good. The second filter portion was prepared using TEC as a plasticizer for acetate tow. The prepared second filter portion was about 15 mm in the length, about 60 $mmH_2O$ in the suction resistance, and about 91% in the hardness. A double cigarette filter was prepared by combining the prepared first filter portion and second filter portion. The prepared double cigarette filter had the suction resistance of about 476 $mmH_2O$ and the hardness of about 93%.

Comparative Example 1

The first filter portion was prepared using TEC as a plasticizer for acetate tow. The prepared first filter portion was about 12 mm in the length, about 57 $mmH_2O$ in the suction resistance, and about 91% in the hardness. The second filter portion was prepared using TEC as a plasticizer for acetate tow. The prepared second filter portion was about 15 mm in the length, about 60 $mmH_2O$ in the suction resistance, and about 91% in the hardness. A double cigarette filter was prepared by combining the prepared first filter portion and second filter portion. The prepared double cigarette filter had the suction resistance of about 465 $mmH_2O$ and the hardness of about 92%.

Physical Properties of Cigarette Filter

When comparing the hardness of the double cigarette filter prepared in Example 2 with the hardness of the double cigarette filter prepared in Comparative Example 1, the double cigarette filter of Example 2 had a slightly higher value than the double cigarette filter of Comparative Example 1, and thus the workability to manufacture the filter was better.

Preparation of Cigarette

Example 3

A cigarette filler portion was prepared using 580 mg of cut tobacco leaves of THE ONE blue, and a cigarette was prepared by combining the double cigarette filter of Example 2 with the cigarette filler portion. The workability of using the double cigarette filter of Example 2 for manufacturing the cigarette was good.

Comparative Example 2

A cigarette filler portion was prepared using 580 mg of cut tobacco leaves of THE ONE blue, and a cigarette was prepared by combining the double cigarette filter of Comparative Example 1 with the cigarette filler portion.

Physical Properties of Cigarette

The cigarette of Example 3 was about 860 mg in total weight, about 25 mm in circumference, about 160 mmWG in encapsulated pressure drop (EPD), and about 76% in ventilation rate (VR).

The cigarette of Comparative Example 2 was about 860 mg in total weight, about 25 mm in circumference, about 160 mmWG in encapsulated pressure drop (EPD), and about 76% in ventilation rate (VR).

Smoke Components and Filtering of Cigarette

General smoke components of the cigarette of Example 3 and the cigarette of Comparative Example 2 were shown in Table 1.

TABLE 1

| | TPM (mg/cig. ) | Tar (mg/cig.) | Nicotine (mg/cig.) | CO (mg/cig.) | Puff No. (times) | Moisture (mg/cig.) |
|---|---|---|---|---|---|---|
| Example 3 | 1.52 | 1.30 | 0.11 | 2.4 | 8.5 | 0.12 |
| Comparative Example 2 | 2.36 | 2.01 | 0.16 | 2.5 | 8.4 | 0.19 |
| Reduction rate (%) | 35.4 | 35.7 | 30.8 | — | — | 35.9 |

Referring to Table 1, TPM, tar, nicotine, and moisture as smoke components of the cigarette of Example 3 were reduced by about 30% to about 36% depending on a type compared with the smoke components of Comparative Example 2.

Filter removal abilities of the cigarette of Example 3 and the cigarette of Comparative Example 2 were shown in Table 2

TABLE 2

| | SRE (%) | TRE ( %) | NRE (%) | WRE (%) | Puff No. (Times) |
|---|---|---|---|---|---|
| Example 3 | 77.0 | 76.2 | 63.4 | 30.7 | 6.8 |
| Comparative Example 2 | 67.7 | 62.2 | 52.3 | 39.5 | 6.5 |

SRE was a TPM removal ability of the cigarette, TRE was a tar removal ability of the cigarette, NRE was a nicotine removal ability of the cigarette, and WRE was a moisture removal ability of the cigarette. Referring to Table 2, the TPM removal ability, the tar removal ability, and the nicotine removal ability of the cigarette of Example 3 were about 10% higher than those of the cigarette of Comparative Example 2.

Specific smoke components of the cigarette of Example 3 and the cigarette of Comparative Example 2 were shown in Table 3.

TABLE 3

| | VOCs (μg/cig. ) | Phenolic (μg/cig. ) | Ammonia (mg/cig.) |
|---|---|---|---|
| Example 3 | 111.04 | 33.58 | 1.29 |
| Comparative Example 2 | 130.08 | 51.24 | 1.86 |
| Reduction rate (%) | 14.6 | 34.5 | 30.6 |

Referring to Table 3, VOCs, phenolic, and ammonia as specific smoke components of the cigarette of Example 3 were reduced by about 15% to about 35% depending on a type as compared with the smoke components of Comparative Example 2. The phenolic was associated with the particulate components of the cigarette smoke.

While the preferred embodiment of the present invention has been described in detail, the scope of the present invention is not limited thereto, and various modifications and variations of those skilled in the art using basic concepts of the present invention which have been defined in the appended claims cover the scope of the present invention.

EXPLANATION OF REFERENCE NUMERALS AND SYMBOLS

| [Explanation of Reference Numerals and Symbols] | |
|---|---|
| 1: Cigarette | 10: Cigarette filler portion |
| 20: Cigarette filter portion | 21: First filter portion |
| 22: Second filter portion | 23: Third filter portion |
| 210: Polymer sheet | 211: First polymer layer |
| 212: Second polymer layer | 229: Pores |

The invention claimed is:

1. A cigarette filter comprising:

a first cylindrical filter, which is a multi-layered roll of a single polymer sheet, and a first cigarette filter wrapping paper surrounding the first cylindrical filter, wherein the polymer sheet comprises a first polymer layer comprising polyolefin or polyester, and a second polymer layer comprising polyolefin, the second polymer layer being positioned on the first polymer layer, and wherein the first cylindrical filter comprises:

a core portion, and an outer portion wrapping around the core portion in a cross-sectional view of the first cylindrical filter, the first polymer layer in the core portion that is folded to contact another section of the first polymer layer in the core portion, and the second polymer layer in the core portion that is folded to contact another section of the second polymer layer in the core portion, and the first polymer layer and the second polymer layer alternate in an orderly manner in the outer portion.

2. The cigarette filter of claim 1, further comprising:

a second filter, wherein the second filter is connected to the first filter and positioned at an oral region of the cigarette.

3. The cigarette filter of claim 2, wherein the second filter includes acetate tow, and is surrounded by a second cigarette filter wrapping paper.

4. The cigarette filter of claim 1, wherein the polymer sheet has a horizontal length (a) and a vertical length (b), and is folded irregularly in a direction of the horizontal length (a).

5. A manufacturing method of the cigarette filter according to claim 1, comprising the steps of:

preparing the first polymer layer using polyolefin or polyester;

preparing the polymer sheet by forming the second polymer layer on the first polymer layer using polyolefin;

rolling and irregularly folding the polymer sheet, thereby preparing the first cylindrical filter; and surrounding the first filter with the first cigarette filter wrapping paper.

6. The manufacturing method of the cigarette filter of claim 5, wherein the second polymer layer is laminated on the first polymer layer by a melt-blown process.

7. The manufacturing method of the cigarette filter of claim 6, wherein the polymer sheet is irregularly folded by a crimping process.

8. The manufacturing method of claim 5, wherein neither the first polymer layer nor the second polymer layer contains a plasticizer.

9. The manufacturing method of claim 5, wherein the first polymer layer has a basis weight between 5 GSM to 20 GSM, the second polymer layer has a basis weight between 10 GSM to 30 GSM, the polymer sheet has a horizontal length (a) and a vertical length (b), and a ratio of the horizontal length (a) to a diameter of the first filter portion is 20 to 45.

10. The cigarette filter according to claim 1, wherein neither the first polymer layer nor the second polymer layer contains a plasticizer.

11. The cigarette filter according to claim 1, wherein the first polymer layer has a basis weight between 5 GSM to 20 GSM, the second polymer layer has a basis weight between 10 GSM to 30 GSM, the polymer sheet has a horizontal length (a) and a vertical length (b), and a ratio of the horizontal length (a) to a diameter of the first filter portion is 20 to 45.

12. The cigarette filter according to claim 1, wherein only the second polymer layer, out of the first polymer layer and the second polymer layer, directly contacts the first cigarette filter wrapping paper.

13. The cigarette filter according to claim 1, wherein the outer portion is placed between the core portion and the first cigarette filter wrapping paper.

14. The cigarette filter according to claim 1, wherein the core portion contains a crimped first polymer layer portion and a crimped second polymer layer portion.

15. The cigarette filter according to claim 1, wherein the polymer sheet is packed more densely in the outer portion than in the core portion.

16. The cigarette filter according to claim 1, wherein the polymer sheet in the outer portion spirals around the polymer sheet in the core portion in a cross-sectional view.

17. The cigarette filter according to claim 1, wherein an inner surface of the first cigarette filter wrapping paper is aligned with an outermost surface of the second polymer layer in the outer portion.

18. A cigarette comprising:

a cigarette filler portion;

a cigarette paper surrounding the cigarette filler portion;

a cigarette filter portion connected to the cigarette filler portion; and a tipping paper connecting the cigarette filler portion and the cigarette filter portion, wherein the cigarette filter portion comprises a first cylindrical filter, which is a multi-layered roll of a single polymer sheet, and a first cigarette filter wrapping paper surrounding the first cylindrical filter, wherein the polymer sheet comprises a first polymer layer comprising polyolefin or polyester, a second polymer layer comprising polyolefin, the second polymer layer being positioned on the first polymer layer, and wherein the first cylindrical filter comprises:

a core portion, and an outer portion wrapping around the core portion in a cross-sectional view of the first cylindrical filter, the first polymer layer in the core portion that is folded to contact another section of the first polymer layer in the core portion, and the second polymer layer in the core portion that is folded to contact another section of the second polymer layer in the core portion, and the first polymer layer and the second polymer layer alternate in an orderly manner in the outer portion.

19. The cigarette according to claim 18, wherein neither the first polymer layer nor the second polymer layer contains a plasticizer.

20. The cigarette according to claim 18, wherein the first polymer layer has a basis weight between 5 GSM to 20 GSM, the second polymer layer has a basis weight between 10 GSM to 30 GSM, the polymer sheet has a horizontal length (a) and a vertical length (b), and a ratio of the horizontal length (a) to a diameter of the first filter portion is 20 to 45.

* * * * *